US005208843A

United States Patent [19]

Marumo et al.

[11] Patent Number: 5,208,843

[45] Date of Patent: May 4, 1993

[54] ROTARY X-RAY TUBE AND METHOD OF MANUFACTURING CONNECTING ROD CONSISTING OF PULVERIZED SINTERED MATERIAL

[75] Inventors: Hitoshi Marumo, Kamakura; Masaru Ishizuka, Kawasaki; Takeshi Nishioka, Yokohama; Tomiya Sasaki, Kawasaki, all of Japan

[73] Assignee: Kabushiki Kaisha Toshiba, Kawasaki, Japan

[21] Appl. No.: 700,861

[22] Filed: May 16, 1991

[30] Foreign Application Priority Data

May 16, 1990 [JP] Japan ..... 2-124085
Nov. 29, 1990 [JP] Japan ..... 2-325209

[51] Int. Cl.[5] ..... H01J 35/10

[52] U.S. Cl. ..... 378/125; 378/141; 378/144; 378/199

[58] Field of Search ..... 378/125, 132, 129, 144, 378/127, 143, 45, 141, 130, 199

[56] References Cited

U.S. PATENT DOCUMENTS

| | | | |
|---|---|---|---|
| 4,574,388 | 3/1986 | Port et al. | 378/144 |
| 4,870,672 | 9/1989 | Lindberg | 378/129 |
| 4,876,705 | 10/1989 | Delair et al. | 378/144 |
| 4,916,015 | 4/1990 | Schaffner et al. | 378/141 |
| 4,943,989 | 7/1990 | Lounsberry et al. | 378/130 |
| 4,945,562 | 7/1990 | Staub | 378/130 |
| 4,953,190 | 8/1990 | Kukoleck et al. | 378/129 |

FOREIGN PATENT DOCUMENTS 60-163355 8/1985 Japan .

OTHER PUBLICATIONS

JSME Mechanical Engineers' Handbook, Section B2, p. 112.

Standard Handbook for Mechanical Engineers, Chap. 4, Sec. B2 "Plastic Working", 1987–no translation provided.

*Primary Examiner*—David P. Porta
*Assistant Examiner*—Kim-Kwok Chu
*Attorney, Agent, or Firm*—Oblon, Spivak, McClelland, Maier & Neustadt

[57] ABSTRACT

A rotary anode x-ray tube includes a vacuum vessel in which a cathode, an anode target, a connecting rod, a rotor, bearings, and a heat conducting plate are arranged. The cathode electrode emits electrons. The anode target generates x-rays when electrons emitted from the cathode electrode collide with the target. The connecting rod supports the anode target. The connecting rod is constituted by a rod member consisting of a pulverized sintered material. The rotor is mounted on the connecting rod. The anode target is rotatably supported by the bearings. The heat conducting plate is arranged between the anode target and the rotor. A heat conducting plate made of a material having excellent heat conduction characteristics can be arranged between the anode target and the rotor. The connecting rod is manufactured by processes such as plasticization including tube spinning.

26 Claims, 13 Drawing Sheets

HEAT CONDUCTIVITY
(W·m⁻¹·K⁻¹)
10
100
Al2O3
AlN
Si
Al
Cu
BeO
SiC

BREAKDOWN VOLTAGE
(KV/cm)
2
100
1000
SiC
Al2O3
AlN
BeO
EPOXY RESIN

DIELECTRIC CONSTANT
(ε, 1MHz)
50
10
1
SiC
AlN
BeO
Al2O3

THERMAL EXPANSION
COEFFICIENT (X10⁻⁶°C⁻¹)
1
10
100
Si
SiC
AlN
BeO
Al2O3
Cu
Al

FLEXURAL STRENGTH
(Kg/mm²)
10
100
BeO
Al2O3
AlN
SiC

ROTARY X-RAY TUBE AND METHOD OF MANUFACTURING CONNECTING ROD CONSISTING OF PULVERIZED SINTERED MATERIAL

BACKGROUND OF THE INVENTION

1. Field of the Invention

The present invention relates to a rotary anode x-ray tube and a method of manufacturing a connecting rod arranged in the rotary anode x-ray tube.

2. Description of the Related Art

A conventional rotary anode x-ray tube has the following arrangement. A cathode electrode and an anode target are arranged in a vacuum vessel evacuated to a high degree of vacuum to oppose each other. The cathode electrode emits electrons. The anode target is fixed to a rotor through a connecting rod. The rotor is connected to a rotating shaft and is rotatably supported by a fixing portion through ball bearings. The rotor is rotated by a rotating magnetic field generated by a rotating magnetic field generator (not shown) arranged around the vacuum vessel. Upon rotation of the rotor, the anode target is integrally rotated.

In such a rotary anode x-ray tube, when electrons emitted from the cathode collide with the anode target, heat is generated together with x-rays. At this time, the anode target is heated to a temperature as high as 1,000° C. or more.

When the anode target is heated to such a high temperature, the heat is conducted to the ball bearings by radiation and through the connecting rod, the rotating shaft, and the like. Of the ball bearings, those located near the anode target are especially heated to high temperatures. Under the circumstances, in x-ray tubes, one of the technical problems to be solved is how to lubricate ball bearings arranged in a high-temperature environment.

Especially in recent years, the use of high-intensity x-rays has been demanded in many cases in terms of x-ray applications. In order to satisfy this demand, the amount of collisions of hot electrons with an anode target must be increased to increase the amount of x-rays to be generated.

As described above, however, as the amount of x-rays is increased, lubrication of ball bearings becomes more difficult.

As has been described above, in the conventional rotary anode x-ray tube, with an increase in x-ray output, the temperatures of the ball bearings near the anode target are increased. This leads to difficulty in lubrication of the ball bearings.

SUMMARY OF THE INVENTION

The present invention has been made to solve the above-described problem, and has as its object to provide a rotary anode x-ray tube and a method of manufacturing a connecting rod arranged in the rotary anode x-ray tube, in which even if an x-ray output is increased, the temperature of a bearing portion is not increased much, thus preventing a deterioration in lubricating function.

In order to achieve the above object, there is provided a method of manufacturing a connecting rod for connecting an anode target and a rotor of a rotary anode x-ray tube to each other, wherein an annular member consisting of a sintered material is subjected to processes including plasticization to pulverize crystal grains of the sintered material.

In addition, the above object can be achieved by a connecting rod manufactured by the following manufacturing method. There is provided a method of manufacturing a connecting rod for connecting an anode target and a rotor of a rotary anode x-ray tube to each other, comprising:

the first step of preparing a sintered material;

the second step of pulverizing the sintered material;

the third step of forming the pulverized sintered material into a tubular member; and the fourth step of sintering the tubular member.

The above object can be achieved by a rotary anode x-ray tube comprising:

a vacuum vessel;

a cathode electrode, arranged in the vacuum vessel, for emitting electrons;

an anode target, arranged in the vacuum vessel, for generating x-rays when electrons emitted from the cathode electrode collide with the anode target;

a connecting rod, arranged in the vacuum vessel, for supporting the anode target, the connecting rod being manufactured by any one of the above methods to be constituted by a pulverized sintered material;

a rotor arranged in the vacuum vessel and mounted on the connecting rod; and bearings, arranged in the vacuum vessel, for rotatably supporting the anode target.

Furthermore, the above object can be achieved by a rotary anode x-ray tube comprising:

a vacuum vessel;

a cathode electrode, arranged in the vacuum vessel, for emitting electrons;

an anode target, arranged in the vacuum vessel, for generating x-rays when electrons emitted from the cathode electrode collide with the anode target;

a connecting rod, arranged in the vacuum vessel, for supporting the anode target;

a rotor arranged in the vacuum vessel and mounted on the connecting rod;

bearings, arranged in the vacuum vessel, for rotatably supporting the anode target; and a heat conducting plate arranged between the anode target and the rotor and essentially consisting of a material having excellent heat conduction characteristics.

In the above-described rotary anode x-ray tube, when electrons from the cathode electrode collide with the anode target, and the anode target is heated to a high temperature, the heat is conducted to the bearings through the connecting rod by heat conduction. Since the connecting rod is made of the sintered material having pulverized crystal grains and has high strength (rigidity), its cross-sectional area can be reduced to allow a considerably large increase in heat resistance. As a result, only a small amount of heat is conducted from the anode target to the bearings by heat conduction, and an increase in temperature of the bearings (especially that located near the anode target) can be greatly suppressed, thus preventing a deterioration in lubricating function of the bearings.

In addition, since the heat conducting plate is arranged between the anode target and the rotor, most of the heat conducted from the anode target by radiation is dissipated to a coolant through the vacuum vessel. With this, only a small amount of heat is conducted from the anode target to the bearings by radiation, and an increase in temperature of the bearings (especially that located near the anode target) can be greatly suppressed, thus preventing a deterioration in the lubricating function of the bearings. Therefore, the x-ray output can be increased.

Moreover, since the amount of heat directly and indirectly conducted from the anode target to the bearings can be minimized, the present invention is very effective.

Additional objects and advantages of the invention will be set forth in the description which follows, and in part will be obvious from the description, or may be learned by practice of the invention. The objects and advantages of the invention may be realized and obtained by means of the instrumentalities and combination particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 9A to 9E are graphs for explaining the characteristics of ceramic materials, each used for a heat conducting plate arranged in the rotary anode x-ray tube of the present invention, in which FIG. 9A is a graph showing the heat conduction characteristics of the ceramic materials, each used for a heat conducting plate, FIG. 9B is a graph showing the breakdown voltage characteristics of the ceramic materials, each used for a heat conducting plate, FIG. 9C is a graph showing the dielectric constant characteristics of the ceramic materials, each used for a heat conducting plate, FIG. 9D is a graph showing the thermal expansion coefficient characteristics of the ceramic materials, each used for a heat conducting plate, and FIG. 9E is a graph showing the flexural strength characteristics of the ceramic materials, each used for a conducting plate;

DETAILED DESCRIPTION OF THE PREFERRED EMBODIMENTS

The gist of a rotary anode x-ray tube according to the first embodiment of present invention will b described below with reference to FIGS. 1 to 6.

Figure 1:
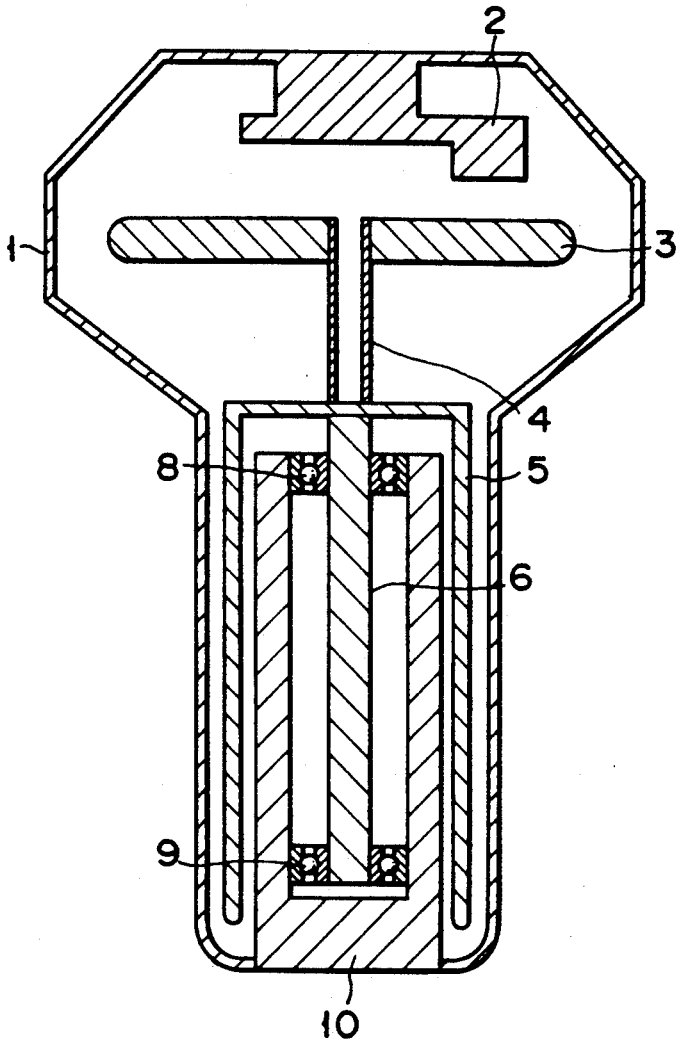
FIG. 1 is a schematic sectional view showing a rotary anode x-ray tube according to the first embodiment of the present invention.

FIG. 1 is a schematic sectional view showing a rotary anode x-ray tube according to the first embodiment of the present invention. As shown in FIG. 1, a cathode electrode 2 and an anode target 3 are arranged in a vacuum vessel 1 evacuated to a high degree of vacuum to oppose each other. The cathode electrode 2 emits electrons. The anode target 3 is fixed to a rotor 5 through a connecting rod 4. The vacuum vessel 1 is generally made of glass but may be made of a metal material, a combination of glass and a metal material, or a non-metallic material. The rotor is connected to a rotating shaft 6. The rotating shaft 6 is rotatably supported by a fixing portion 10 through ball bearings 8 and 9. The rotor 5 is rotated by a rotating magnetic field generated by a rotating magnetic field generator (not shown) arranged around the vacuum vessel 1. Upon rotation of the rotor 5, the anode target 3 is rotated together with the rotor 5. In addition, a space around the vacuum vessel 1 is filled with, e.g., an oil (not shown) for electrically insulating and cooling the tube 1. The vacuum vessel 1 and the fixing portion 10 are in direct contact with this oil. This basic structure of the rotary anode x-ray tube is almost the same as that of the conventional anode x-ray tube. However, the rotary anode x-ray tube of the first embodiment is characterized by the connecting rod 4 itself.

The characteristic features and manufacturing method of the connecting rod of this embodiment will be described below with reference to FIGS. 2 to 5. The characteristic features of the connecting rod 4 will be described first. Since the connecting rod 4 is directly influenced by heat from the anode target 3 and is heated to a high temperature, the rod 4 is made of a sintered material consisting of molybdenum or tungsten which exhibits high strength in a high-temperature environment. A sintered material actually used in this embodiment is an alloy called "TZM" standardized in the U.S.A. More specifically, this alloy is ASTM-B387-85TYPE364R of TZM and has a composition (0.5% Ti+0.8% Zr+0.03% C+Mp).

Figure 4A:
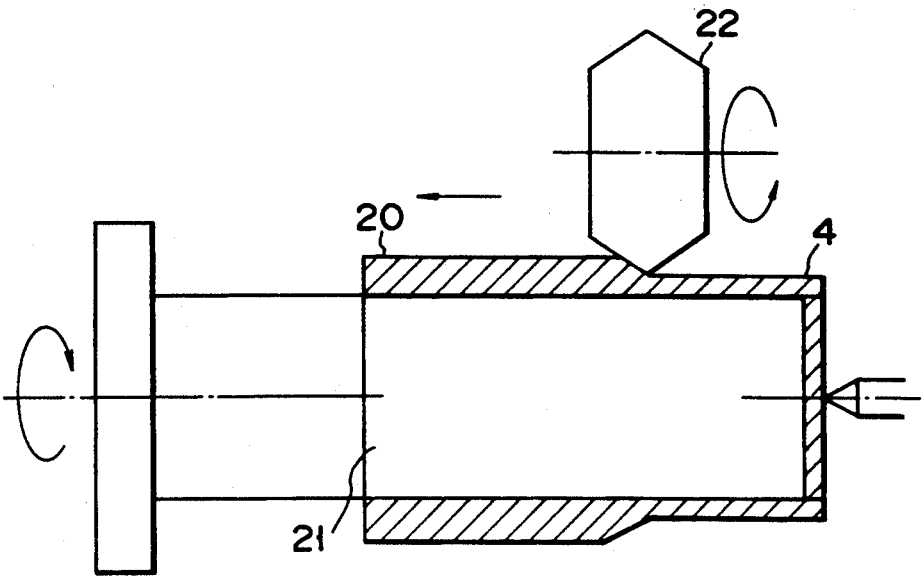
FIGS. 4A and 4B are views respectively illustrating practical examples of the first method of manufacturing a connecting rod arranged in the rotary anode x-ray tube of the present invention.
Figure 4B:
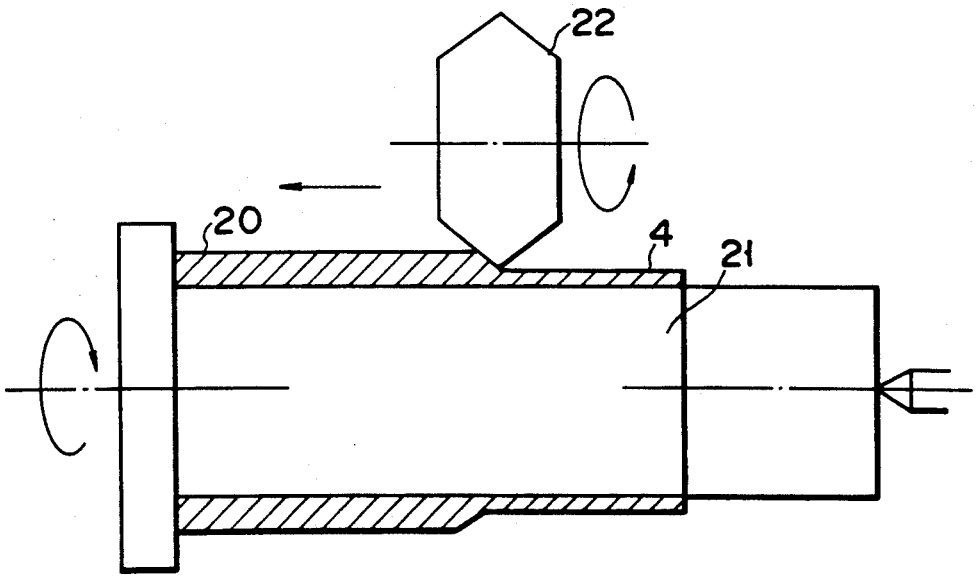
Figure 5:
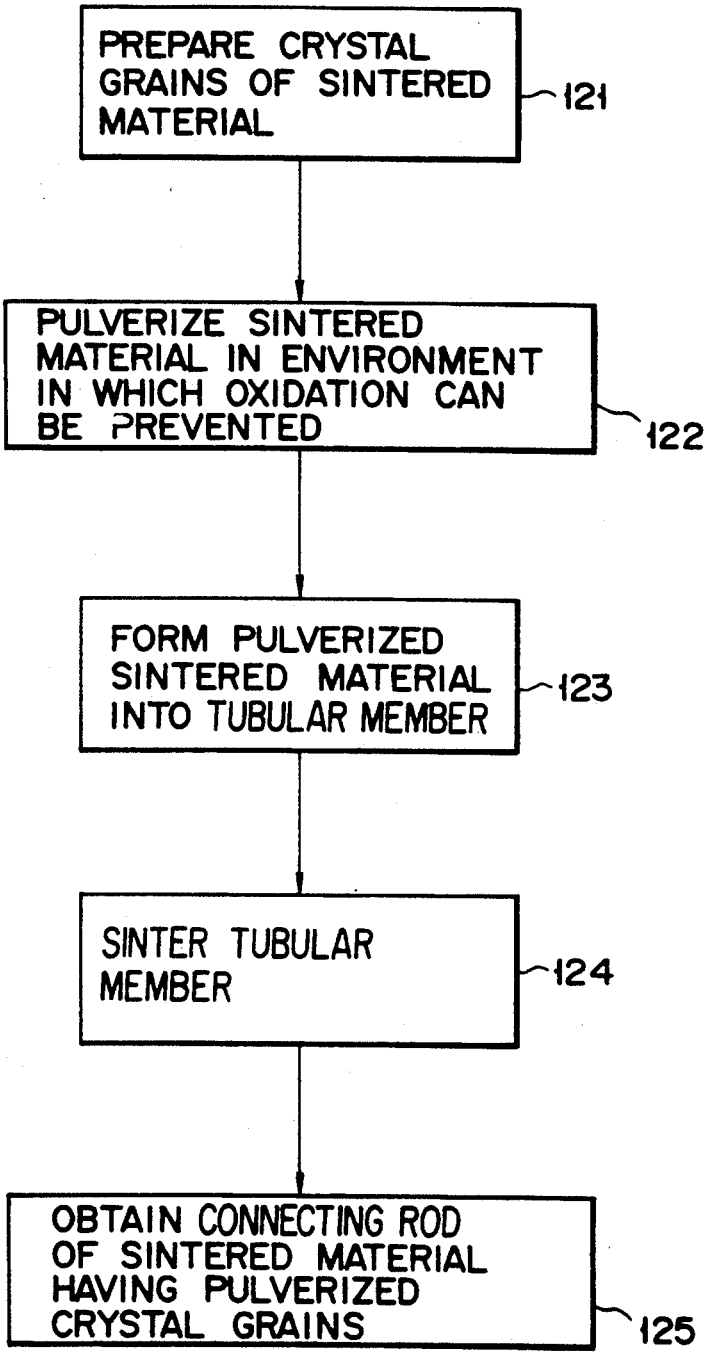
FIG. 5 is a flow chart showing the steps in the second method of manufacturing a connecting rod arranged in the rotary anode x-ray tube of the present invention.

Such a connecting rod 4 is manufactured by the first manufacturing method based on plasticization shown in FIGS. 2, 3, 4A, and 4B or the second manufacturing method shown in FIG. 5 which is not based on plasticization.

Figure 2:
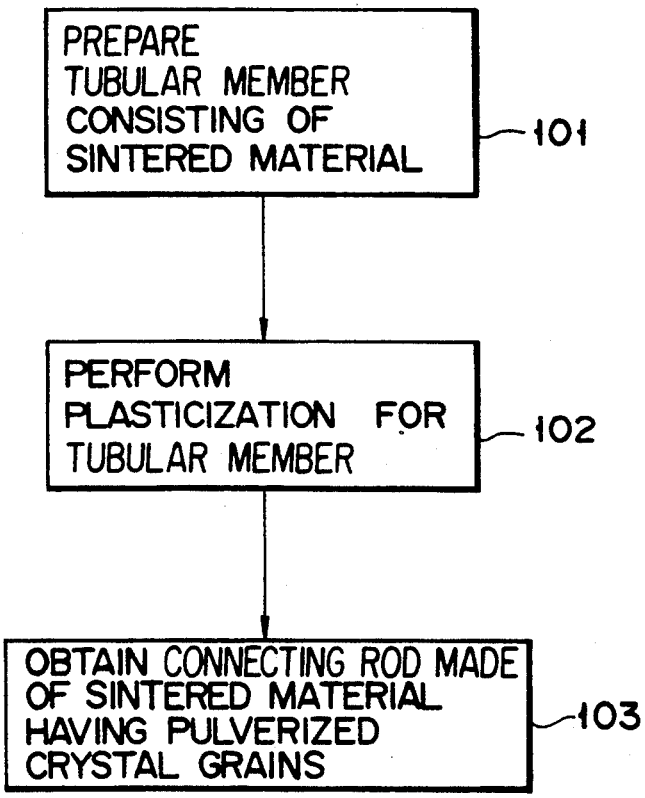
FIGS. 2 and 3 are flow charts showing the steps in the first method of manufacturing a connecting rod arranged in the rotary anode x-ray tube of the present invention.
Figure 3:
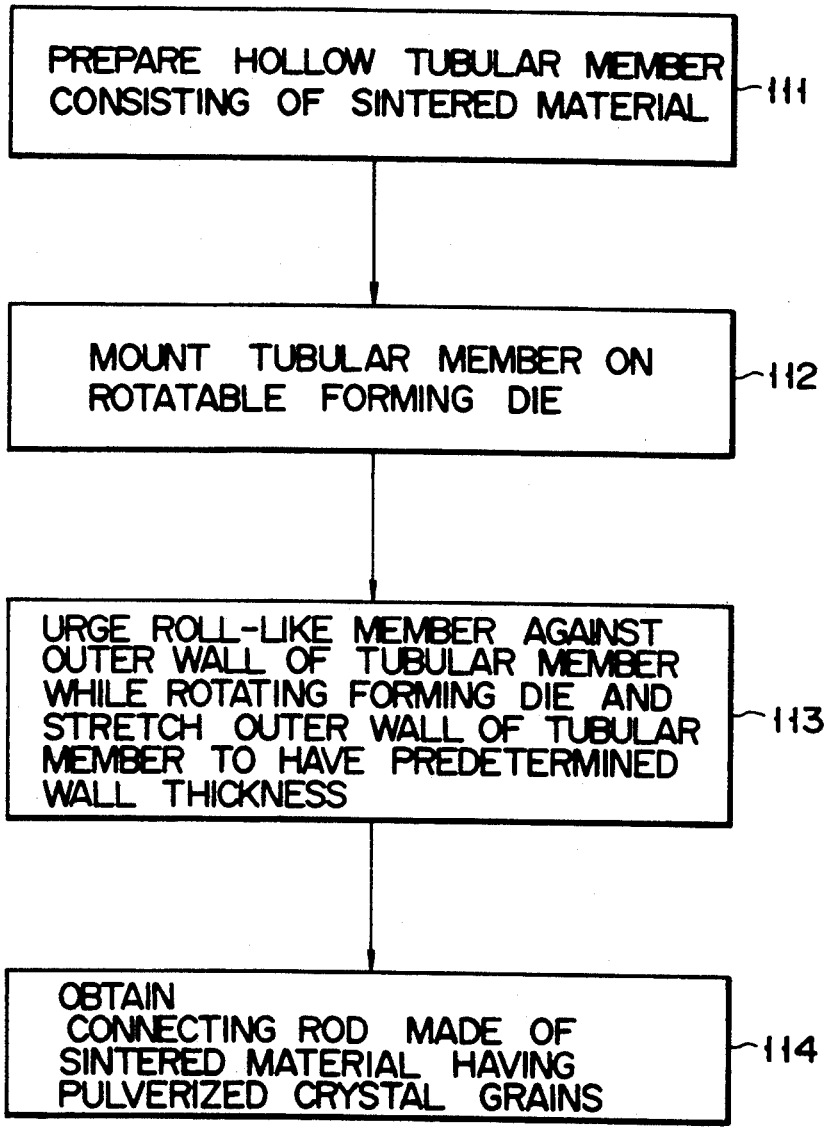

The first method of manufacturing a rod member such as the connecting rod 4 in this embodiment, which exhibits high strength in a high-temperature environment is realized by a plurality of steps shown in FIG. 2. The first manufacturing method is based on plasticization. More specifically, in step 101, a rod member made of a sintered material consisting of molybdenum or tungsten as a main component is prepared. In step 102, the tubular member is subjected to processes including plasticization such as tube spinning. In step 103, a connecting rod consisting of fine crystal grains of the sintered material is obtained by the tubular member. The first manufacturing method will be further described below with reference to FIG. 3. In step 111, a hollow tubular member made of a sintered material is prepared. In step 112, this tubular member is mounted on a rotatable forming die. In step 113, a roll-like member is urged against the outer wall of the tubular member while the forming die is rotated, thus stretching the tube wall of the tubular member to have a predetermined wall thickness. In steps 111 to 113, a connecting rod consisting of fine crystal grains of the sintered material is obtained by the tubular member.

A practical example of the first method of manufacturing the connecting rod 4 described above with reference to FIGS. 2 and 3 will be described below with reference to FIGS. 4A and 4B. As shown in FIGS. 4A and 4B, a tubular member (a basic member of the connecting rod 4) 20 having a wall thickness of several millimeters is mounted on a forming die 21. The tubular member 20 and the forming die 21 are rotated together. A rotating member such as a roll 22 is urged against the outer wall of the tubular member 20. The wall of the tubular member 20 is axially spun by the roll 22 to be stretched. With this operation, the hollow connecting rod 4 having a predetermined wall thickness is formed.

Note that a method of processing the tubular member 20 by moving it in the same direction as the moving direction of the roll 22 while a non-processed portion of the tubular member 20 is set as a free end as shown in FIG. 4A is called forward tube spinning. In contrast to this, a method of processing the tubular member 20 by moving it in a direction opposite to the moving direction of the roll 22 (toward the rear surface of the roll 22) while a non-processed portion of the tubular member 20 is restrained as shown in FIG. 4B is called backward tube spinning. In backward tube spinning, a portion of the connecting rod 4 processed by extrusion is a free end.

The definitions of the above-described tube spinning, forward tube spinning, and backward tube spinning are based on the following publication:

JSME Mechanical Engineers' Handbook, Section B2

Processing Technique.Processing Machinery, p. 112, FIGS. 260(c) and 260(d)

The connecting rod 4 manufactured by the first manufacturing method is a hollow rod having a wall thickness of 1 mm or less because it is obtained by processing the tubular member 20 made of a sintered material such as molybdenum by tube spinning.

When cross-sections of a material before tube spinning and the connecting rod 4 obtained by tube spinning as in the present invention are enlarged and observed, the following can be said. A sintered material such as molybdenum has relatively large crystal grains and defects scattering in the crystal. However, it is found that after tube spinning is performed, the crystal grains are reduced in size, and the defects are also reduced. As the crystal grains are reduced in size, the rigidity of the material is considerably increased. With the increase in rigidity, the following effects are obtained. The sintered material such as molybdenum produce the stickiness phenomenon by the plasticization (the tube spinning).

As described above with reference to the conventional problem, when the anode target 3 is heated to a high temperature, most of the heat is directly conducted to the ball bearings 8 through the connecting rod 4. The remaining heat is indirectly conducted to the ball bearings 8 by radiation. Therefore, the amount of heat conducted to the ball bearings 8 can be reduced by increasing the heat resistance of the connecting rod 4. In order to reduce the amount of heat conducted by heat conduction, the following cases A and B can be employed:

case A: forming the connecting rod 4 from a material having a small heat conductivity; and case B: reducing the cross-sectional area of the connecting rod 4 and increasing its length.

In the case A, however, since the connecting rod 4 is heated to a high temperature, the rod 4 must be made of a heat-resistant material. In addition, since the connecting rod 4 is rotated at a high speed while the anode target 3 is supported thereby, the rod 4 must have high rigidity. It is difficult to find a material which satisfies such conditions and has a small heat conductivity among existing materials.

In the case B, since the length of the connecting rod 4 cannot be increased beyond a required length in terms of specifications, an increase in heat resistance cannot be expected much. In order to reduce the cross-sectional area of the rod 4 to increase its heat resistance, the rod 4 may be narrowed or may be hollowed out to reduce its wall thickness.

When the solid and hollow connecting rods 4 having the same heat resistance are compared, it is found that the latter is much superior to the former in strength for supporting the anode target 3. Therefore, the hollow connecting rod 4 has higher rigidity and larger heat resistance and is preferable for this embodiment Even with the hollow connecting rod 4, the conventional problem cannot be simply solved due to trade-off between heat resistance and rigidity. That is, as the wall thickness of the hollow rod 4 is increased, its heat resistance is increased, but its rigidity is decreased.

Under the circumstances, according to the present invention, a sintered material consisting of molybdenum as a main component is processed by tube spinning to reduce the size of each crystal grain and crystal defects. In addition, by tube spinning, the hollow connecting rod 4 can be processed with high precision, while the rigidity and heat resistance of the rod are increased. With such a process for achieving high rigidity, in the present invention, even if the thickness of a hollow connecting rod is set to be 1 mm or less, a required rigidity can be obtained, which cannot be obtained in the art, even if a connecting rod is processed into a hollow rod, unless its thickness is set to be several millimeters. With this decrease in wall thickness of the hollow connecting rod 4, its heat resistance can be greatly increased.

Since the connecting rod 4 is rotated at high speed while the anode target 3 is fixed to one end of the rod 4, high dimensional precision is required to prevent unstable rotation. The hollow connecting rod 4 is generally formed in such a manner that the solid connecting rod 4 is processed with high precision, and he rod 4 is bored to have a predetermined wall thickness with high precision. Since a process requiring high precision is performed in the two steps, errors tend to be accumulated, and the number of steps is increased. According to tube spinning employed in the present invention, however, since a process requiring high precision can be performed in one step, errors are not accumulated, resulting in high precision.

In addition, since tube spinning is a process for decreasing the wall thickness of the rod 4 by plastic deformation, the yield of materials is increased in comparison with a cutting process or the like.

As described above, according to the present invention, even if the anode target 3 is heated to a high temperature, since the connecting rod 4 has a large heat resistance, the amount of heat conducted to the ball bearings 9 by heat conduction is decreased. As a result, an increase in temperature of the ball bearing 8 near the anode target 3 can be considerably suppressed.

The second method of manufacturing a rod member such as the connecting rod 4 of this embodiment, which exhibits high strength in a high-temperature environment, is realized by a plurality of steps shown in FIG. 5. The second manufacturing method is not based on plasticization unlike the first manufacturing method based on plasticization. More specifically, in step 121, a sintered material consisting of molybdenum or tungsten as a main component is prepared. In step 122, the sintered material is pulverized in an environment in which oxidation can be prevented. Pulverization is performed by grinding and smashing grains. In step 123, the pulverized sintered material is formed into a tubular member. This process is performed in the same manner as in the first manufacturing method. In step 124, the tubular member is sintered. With this process, a connecting rod 4 consisting of fine crystal grains of the sintered material is obtained by the tubular member. By employing such a method, a rod member such as the connecting rod 4 exemplified above, which exhibits high strength in a high-temperature environment, can also be obtained.

Figure 6:
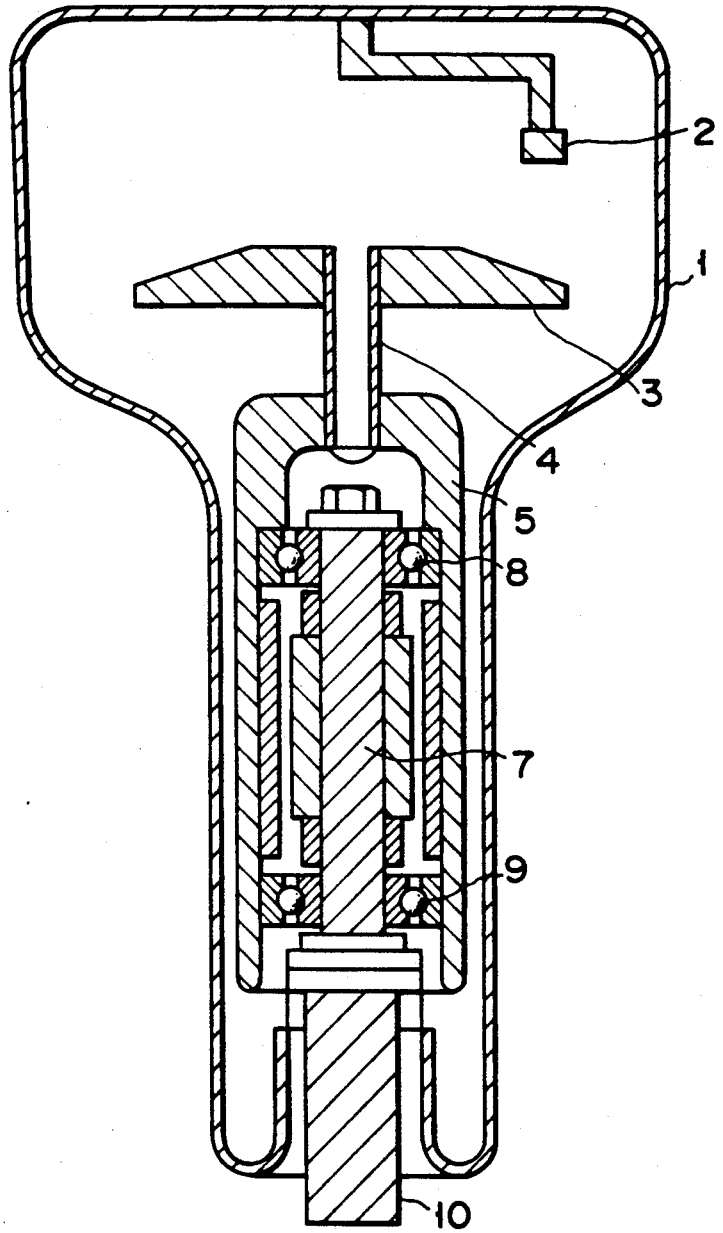
FIG. 6 is a schematic sectional view showing a rotary anode x-ray tube according to the second embodiment of the present invention.

The second embodiment of the present invention will be described below with reference to FIG. 6. The rotary anode x-ray tube of the present invention may have another structure as shown in FIG. 6, in which a fixed shaft 7 is connected to a fixing portion 10, and a rotor 5 is rotatably supported by the fixed shaft 7 through ball bearings 8 and 9. The present invention can be applied to all the known structures of rotary anode x-ray tubes. In addition, the connecting rod 4 is not limited to a composite material containing molybdenum as a main component but may be made of another sintered material containing a refractory material, e.g., tungsten, as a main component.

The gist of a rotary anode x-ray tube according to the second embodiment of the present invention will be described below with reference to FIGS. 7 to 13. The rotary anode x-ray tube of the second embodiment is different from the conventional one in that it has a heat conducting plate and is characterized in its material, location, and shape.

A rotary anode x-ray tube according to the third embodiment of the present invention will be described below with reference to FIG. 7. The same reference numerals in FIG. 7 denote the same parts as in FIG. 1 or 6, and a description thereof will be omitted.

Figure 7:
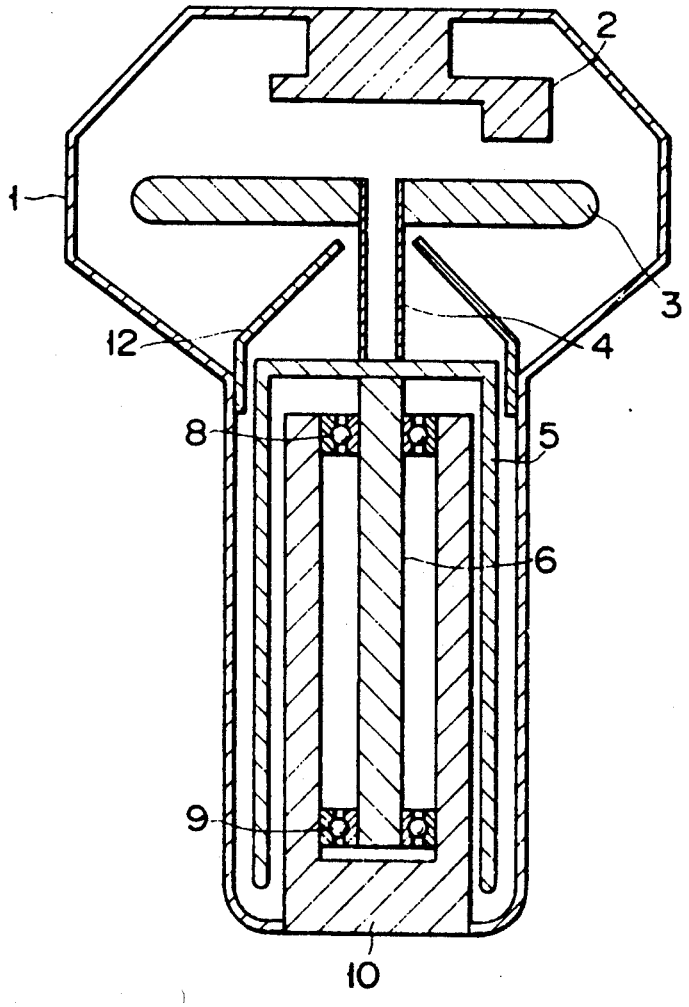
FIG. 7 is a schematic sectional view showing a rotary anode x-ray tube according to the third embodiment of the present invention.

The embodiment shown in FIG. 7 is characterized in that one end of a heat conducting plate 12 is attached to the inner wall of a vacuum vessel 1 to be located between an anode target 3 and a rotor 5 at a position near a connecting rod 4.

With this heat conducting plate 12, most of heat conducted from the anode target 3 to the heat conducting plate 12 by radiation is conducted to the vacuum vessel 1 and a cooling oil by heat conduction. The remaining small amount of heat is conducted from the heat conducting plate 12 to the connecting rod 4 and the rotor 5 by radiation. With the heat conducting plate 12, therefore, most of the heat which is conducted from the anode target 3 to the ball bearings 8 through the connecting rod 4 and the rotor 4 by radiation in the conventional x-ray tube can be conducted to the cooling oil through the vacuum vessel 1, thus reducing the influences of radiated heat to a negligible degree.

A combination of the heat conducting plate 12 with the above-described embodiment can minimize the direct and indirect influences of heat from the anode target 3. Therefore, an increase in temperature of the ball bearing 8 can be suppressed further as compared with the embodiment shown in FIG. 1.

The fourth embodiment of the present invention will be described below with reference to FIG. 8. This embodiment is different from the embodiment shown in FIG. 8 in the mounting state of a heat conducting plate 13 and its material.

The heat conducting plate 13 is a disk-like member having a through hole in its center. A peripheral portion of the disk-like member airtightly extends through a vacuum vessel 1 to be in contact with a cooling oil (not shown). The heat conducting plate 13 is supported by the vacuum vessel 1 by sealing the penetrated portion of the vacuum vessel 1.

Figures 9A, 9B, 9C, 9D, 9E:
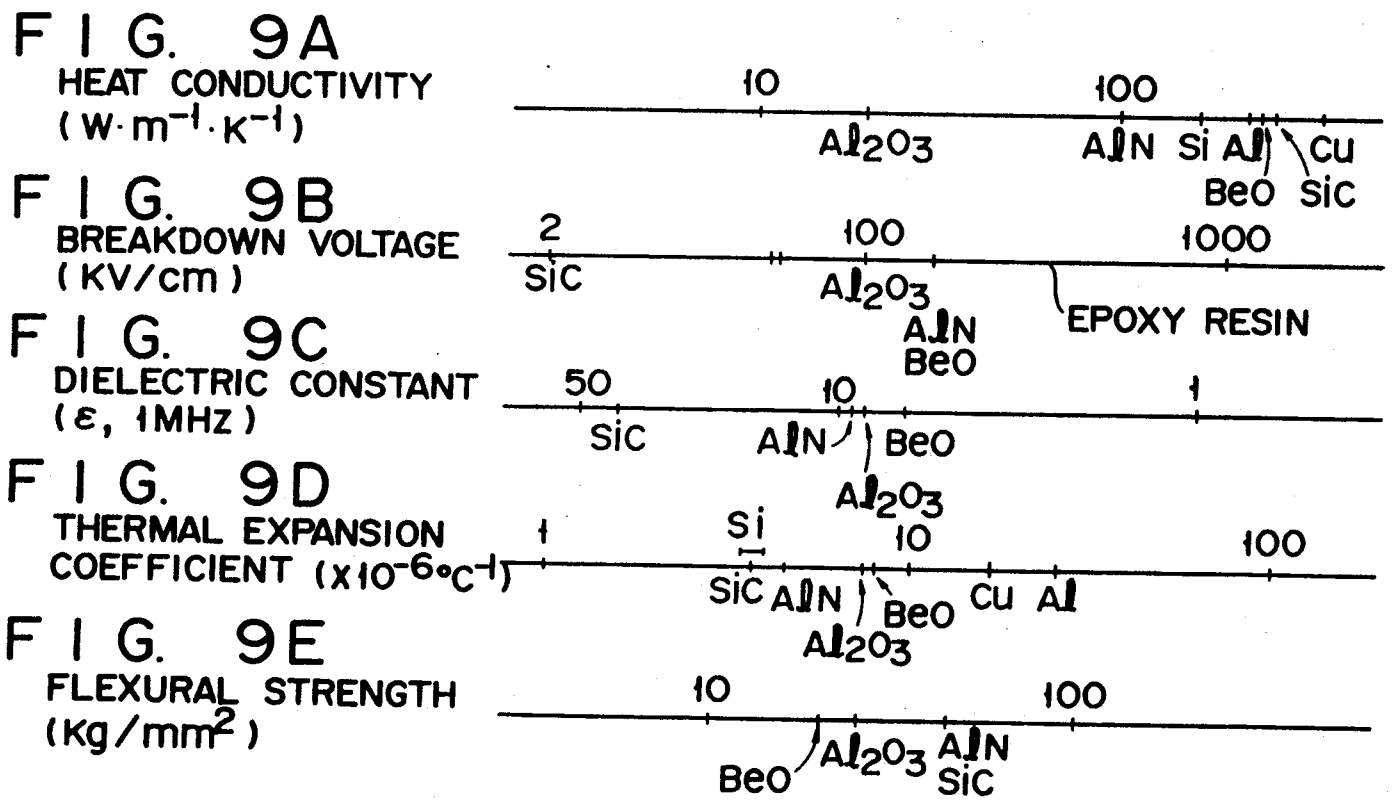

The heat conducting plate 13 is made of a ceramic material. As this ceramic material, AlN, BeO, SiC, or the like is particularly suitable. Such a material is as good as a metal in heat conduction and hence can efficiently conduct heat from the anode target 3 to the cooling oil outside the vacuum vessel 1, thus suppressing an increase in temperature of each ball bearing 8. FIG. 9A shows the heat conductivities of AlN, BeO, and SiC, which are much higher than those of $Al_2O_3$ and the like. Therefore, with the use of such a material, a heat dissipation efficiency as good as that of Al or Cu as a metal can be realized.

The heat conducting plate 13 is made of a ceramic material as an insulating material for the following reason.

Figure 8:
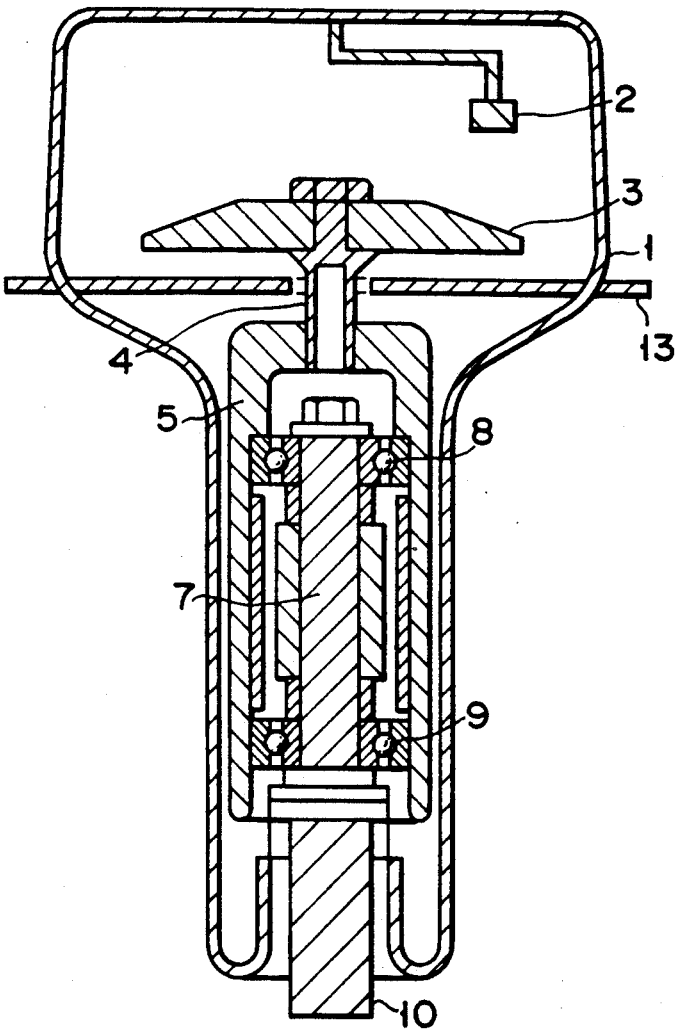
FIG. 8 is a schematic sectional view showing a rotary anode x-ray tube according to the fourth embodiment of the present invention.

In both the embodiments shown in FIGS. 7 and 8, the heat conducting plates 12 and 13 are fixed to the vacuum vessels 1 and are not rotated. That is, the plates 12 and 13 are formed independently of the x-ray tube main bodies. If, therefore, such a plate is made of a conductor, electrical discharge may occurs due to the effect of an electric field upon generation of x-rays.

Figure 10:
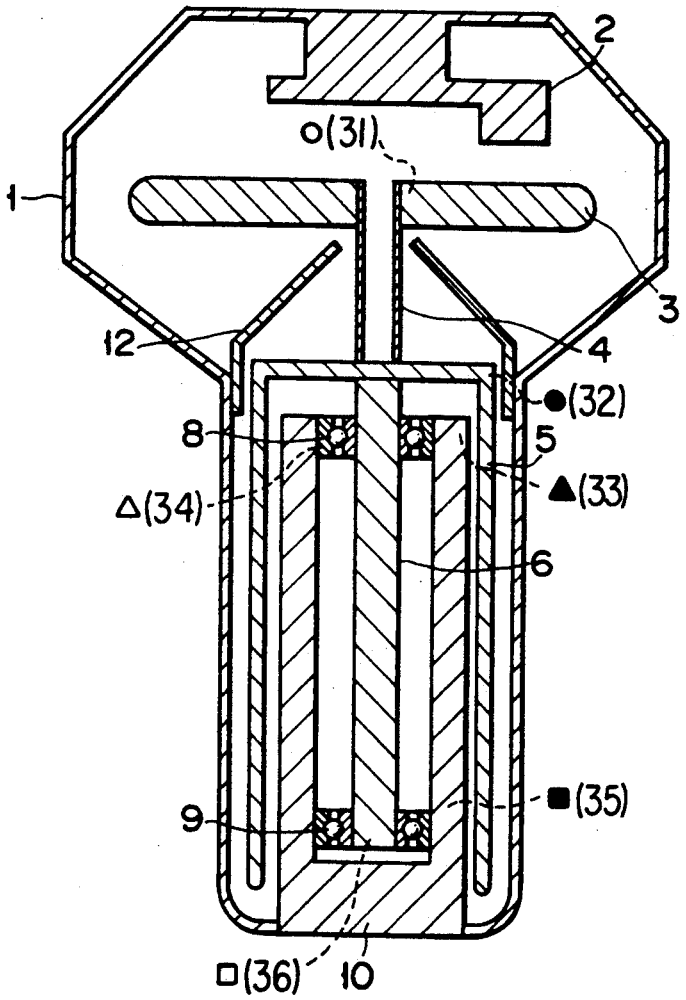
FIGS. 10 and 11 are views for explaining the effects of a heat conducting plate according to the present invention.
Figure 11:
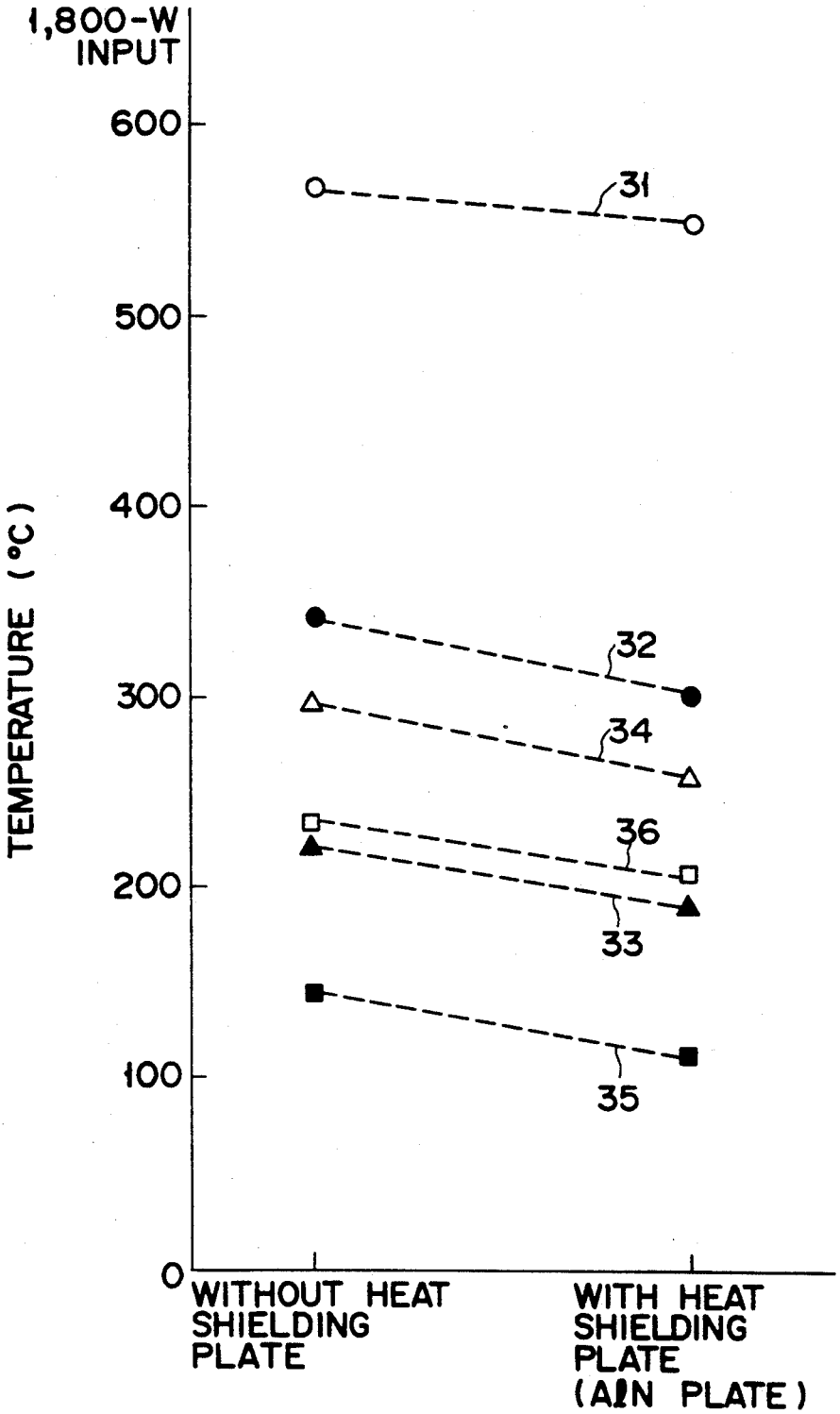

The heat conducting plate 12 shown in FIG. 7 was made of an AlN ceramic material, and experiments and simulations were performed to compare temperatures at the respective portions in x-ray tubes with and without the heat conducting plate 12. FIG. 10 shows the respective temperature measurement portions. FIG. 11 shows the measurement result.

As shown in FIG. 10, the measurement portions were the following six portions: a substantially central portion of the anode target 3 (denoted by reference numeral 31); a shoulder portion (denoted by reference numeral 32) of the rotor 5 near the anode target 3; an outer portion (denoted by reference numeral 33) and an inner portion (denoted by reference numeral 34) of the bearing 8 near the anode target 3; and an inner portion (denoted by reference numeral 35) and an inner portion (denoted by reference numeral 36) of the bearing 9 near the anode target 3.

As is apparent from the result shown in FIG. 11, with the heat conducting plate 12 consisting of the AlN ceramic material, temperatures at all the six measurement portions are lower than those in the vacuum vessel without the heat conducting plate 12.

With regard to the conventional problem of an increase in temperature of each bearing 8 located near the anode target 3, the following result is obtained. At the inner portion (denoted by reference numeral 34) of the bearing 8, which tended to be heated most, about 300° C. was recorded without the heat conducting plate 12, and about 260° C. was recorded with the heat conducting plate 12. That is, a temperature increase can be reduced by about 40° C.

The following is a modification of the material for the heat conducting plate 13 of the fourth embodiment. A portion, of the heat conducting plate 13, which requires an insulating function is a portion which opposes the anode target 3 and with which secondary electrons collide. It is required, therefore, that only this portion is constituted by an insulating member. More specifically, the heat conducting plate 13 can be designed such that the main body is made of a metal having a high heat conductivity, and an insulating member is coated thereon. In this case, the insulating member to be coated is not limited to a ceramic material as long as it has an insulating function.

In the embodiments described above, especially a ceramic material is used as an insulating member, because it is superior to other insulating members in strength at high temperatures In addition, the heat conducting plate 13 may be formed by boding an insulating plate to a conductive plate such that the insulating plate opposes the anode target 3, or by coating a conductive member on an insulating plate surface opposite to the surface facing the node target 3.

Figure 12:
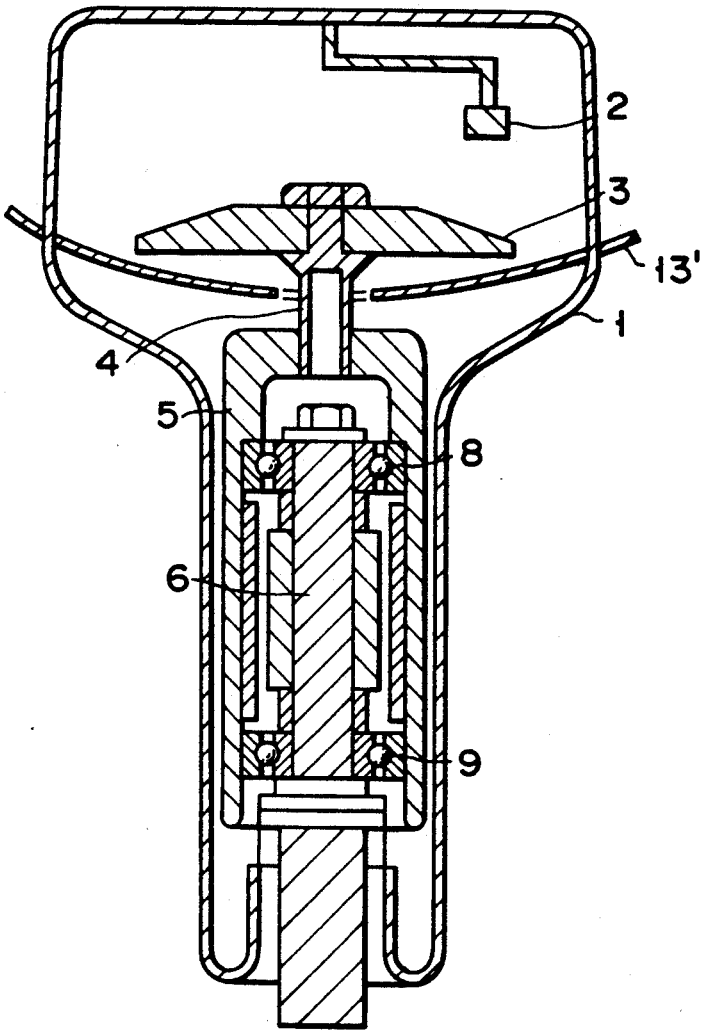
FIG. 12 is a schematic sectional view showing a rotary anode x-ray tube according to the fifth embodiment of the present invention.

The fifth embodiment of the present invention will be described below with reference to FIG. 12. As shown in FIG. 12, a heat conducting plate 13' is formed into a concave plate. By forming the heat conducting plate 13' into the concave plate, heat radiated from an anode target 3 can be accumulated in the heat conducting plate 13' to be efficiently dissipated.

Figure 13:
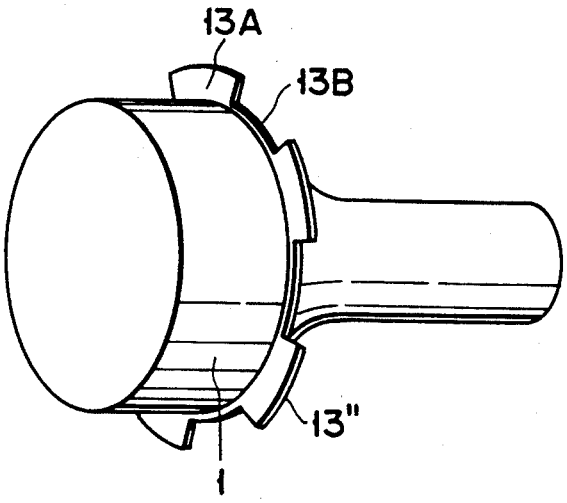
FIG. 13 is a schematic perspective view showing a rotary anode x-ray tube according to the sixth embodiment of the present invention.

The sixth embodiment of the present invention will be described below with reference to FIG. 13. In the sixth embodiment, the heat conducting plate 13 or 13' in the embodiment shown in FIG. 8 or 12 is modified. A heat conducting plate 13'' in the sixth embodiment is characterized in a collar portion 13A exposed from a vacuum vessel 1. The collar portion 13A is an annular member exposed from the outer wall of the vacuum vessel 1. A large number of notched portions 13B are formed in the collar portion 13A in the circumferential direction. The collar portion 13A is formed such that root portions of the notched portions 13B protrude from the outer wall of the vacuum vessel 1. With the collar portion 13A having the large number of notched portions 13B formed therein, heat received by the heat conducting plate 13 or 13' can be effectively dissipated outside the vacuum vessel 1. This is because a heat dissipation area is increased by forming the large number of notched portions 13B in the collar portion 13A.

As has been described in detail above, according to the present invention, since the amount of heat conducted from the anode target to the bearings can be minimized, the lubricating function of the bearings can be stably maintained even with an increase in output of the x-ray tube.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A method of manufacturing a connecting rod having a tubular member for connecting an anode target and a rotor of a rotary anode x-ray tube to each other, wherein the tubular member consisting of a sintered material is subjected to processes including plasticization to pulverize crystal grains of said sintered material.

2. A method according to claim 1, wherein the plasticization includes tube spinning.

3. A method according to claim 1, wherein the plasticization comprises the first step of preparing a tubular member consisting of a sintered material, the second step of mounting said tubular member on a rotatable forming die, and the third step of urging a roll-like member against an outer wall of said tubular member while rotating said forming die, thereby stretching a tube wall of said tubular member to have a predetermined wall thickness.

4. A method according to claim 3, wherein the predetermined wall thickness is not more than 1 mm.

5. A method according to claim 1, wherein said sintered material contains at least one of molybdenum and tungsten as a main component.

6. A method of manufacturing a connecting rod having a tubular member for connecting an anode target of a rotor of a rotary anode x-ray tube to each other, comprising:

the first step of preparing a sintered material;

the second step of pulverizing said sintered material;

the third step of forming said pulverized sintered material into the tubular member; and the fourth step of sintering said tubular member so as to obtain the connecting rod.

7. A method according to claim 6, wherein said sintered material contains at least one of molybdenum and tungsten as a main component.

8. A method according to claim 6, wherein the second step is performed in an environment in which said sintered material is not oxidized.

9. A rotary anode x-ray tube comprising:

a vacuum vessel;

a cathode electrode, arranged in said vacuum vessel, for emitting electrons;

an anode target, arranged in said vacuum vessel, for generating x-rays when electrons emitted from said cathode electrode collide with said anode target;

a connecting rod, arranged in said vacuum vessel, for supporting said anode target, said connecting rod being manufactured by subjecting a tubular member consisting of a sintered material to processes including plasticization to pulverize crystal grains of the sintered material, such that the connecting rod is constituted by a pulverized sintered material;

a rotor arranged in said vacuum vessel and mounted on said connected rod; and bearings, arranged in said vacuum vessel, for rotatably supporting said anode target.

10. A rotary anode x-ray tube comprising:

a vacuum vessel;

a cathode electrode, arranged in said vacuum vessel, for emitting electrons;

an anode target, arranged in said vacuum vessel, for generating x-rays when electrons emitted from said cathode electrode collide with said anode target;

a connecting rod, arranged in said vacuum vessel, for supporting said anode target, said connecting rod being manufactured by preparing a sintered material, pulverizing the sintered material, forming the pulverized sintered material into a tubular member and sintering the tubular member to obtain a connecting rod which is constituted by a pulverized sintered material;

a rotor arranged in said vacuum vessel and mounted on said connecting rod; and bearings, arranged in said vacuum vessel, for rotatably supporting said anode target.

11. A rotary anode x-ray tube comprising:

a vacuum vessel;

a cathode electrode, arranged in said vacuum vessel, for emitting electrons;

an anode target, arranged in said vacuum vessel, for generating x-rays when electrons emitted from said cathode electrode collide with said anode target;

a connecting rod, arranged in said vacuum vessel, for supporting said anode target, said connecting rod being manufactured by subjecting a tubular member consisting of a sintered material to processes including plasticization to pulverize crystal grains of the sintered material, such that the connecting rod is constituted by a pulverized sintered material;

a rotor arranged in said vacuum vessel and mounted on said connecting rod, bearings, arranged in said vacuum vessel, for rotatably supporting said anode target; and a heat conducting plate arranged between said anode target and said rotor and essentially consisting of a material having excellent heat conduction characteristics.

12. A tube according to claim 11, wherein said heat conducting plate essentially consists of a ceramic material.

13. A tube according to claim 12, wherein said ceramic material essentially consists of at least one of an AlN ceramic material, a BeO ceramic material, and an SiC ceramic material.

14. A tube according to claim 11, wherein said heat conducting plate is formed such that a surface opposing said anode target contains an insulator.

15. A tube according to claim 11, wherein said heat conducting plate is fixed to an inner wall of said vacuum vessel.

16. A tube according to claim 11, wherein said heat conducting plate is arranged such that at least a portion thereof airtightly extends through said vacuum vessel to be in contact with a coolant present outside said vacuum vessel.

17. A tube according to claim 11, wherein said heat conducting plate is formed to have a concave surface so as to accumulate heat radiated from said anode target.

18. A tube according to claim 11, wherein said heat conducting plate has one portion connecting said vacuum vessel and the other portion not contacting to said rotor and located at a position near said connecting rod.

19. A rotary anode x-ray tube comprising:

a vacuum vessel;

a cathode electrode, arranged in said vacuum vessel, for emitting electrons;

an anode target, arranged in said vacuum vessel, for generating x-rays when electrons emitted from said cathode electrode collide with said anode target;

a connecting rod, arranged in said vacuum vessel, for supporting said anode target, said connecting rod being manufactured by preparing a sintered material, pulverizing the sintered material, forming the pulverized sintered material into a tubular member, and sintering the tubular member to obtain a connecting rod which is constituted by a pulverized sintered material;

a rotor arranged in said vacuum vessel and mounted on said connecting rod, bearings, arranged in said vacuum vessel, for rotatably supporting said anode target; and a heat conducting plate arranged between said anode target and said rotor and essentially consisting of a material having excellent heat conduction characteristics.

20. A tube according to claim 19, wherein said heat conducting plate essentially consists of a ceramic material.

21. A tube according to claim 20, wherein said ceramic material essentially consist of at least one of an AlN ceramic material, a BeO ceramic material, and an SiC ceramic material.

22. A tube according to claim 19, wherein said heat conducting plate is formed such that a surface opposing said anode target contains an insulator.

23. A tube according to claim 19, wherein said heat conducting plate is fixed to an inner wall of said vacuum vessel.

24. A tube according to claim 19, wherein said heat conducting plate is arranged such that at least a portion thereof airtightly extends through said vacuum vessel to be in contact with a coolant present outside said vacuum vessel.

25. A tube according to claim 19, wherein said heat conducting plate is formed to have a concave surface so as to accumulate heat radiation from said anode target.

26. A tube according to claim 19, wherein said heat conducting plate has one portion connected to said vacuum vessel and the other portion not contacting said rotor and located at a position near said connecting rod.

* * * * *